US005701964A

United States Patent [19]

Walker et al.

[11] Patent Number: 5,701,964

[45] Date of Patent: Dec. 30, 1997

[54] PERFORATING CHARGE CARRIER ASSEMBLY AND METHOD

[75] Inventors: Jerry L. Walker, Fort Worth; James P. Lawson, Mansfield; Bennie C. Gill, Burleson, all of Tex.

[73] Assignee: Halliburton Energy Services, Inc., Houston, Tex.

[21] Appl. No.: 651,229

[22] Filed: May 22, 1996

Related U.S. Application Data

[63] Continuation-in-part of Ser. No. 311,284, Sep. 22, 1994, Pat. No. 5,590,723.

[51] Int. Cl.[6] ..... E21B 43/116

[52] U.S. Cl. ..... 175/4.6; 102/312; 102/321

[58] Field of Search ..... 175/4.51, 4.55, 175/4.6; 166/55.1, 55.2; 102/312, 320, 321

[56] References Cited

U.S. PATENT DOCUMENTS

| | | | |
|---|---|---|---|
| 2,799,224 | 7/1957 | Long | 102/20 |
| 2,927,534 | 3/1960 | Le Bus | 102/20 |
| 3,094,930 | 6/1963 | Blair | 102/20 |
| 3,100,443 | 8/1963 | Pohoriles | 102/20 |
| 4,326,462 | 4/1982 | Garcia et al. | 102/310 |
| 4,393,946 | 7/1983 | Pottier et al. | 175/4.56 |
| 4,598,775 | 7/1986 | Vann et al. | 175/4.6 |
| 4,658,900 | 4/1987 | Stout | 166/297 |
| 4,681,037 | 7/1987 | Regalbuto | 102/310 |
| 4,694,754 | 9/1987 | Dines et al. | 102/310 |
| 4,829,901 | 5/1989 | Yates, Jr. | 102/306 |
| 4,832,134 | 5/1989 | Gill | 102/310 |
| 4,881,445 | 11/1989 | Hayes | 89/1.15 |
| 4,951,744 | 8/1990 | Rytlewski | 175/4.57 |
| 5,095,999 | 3/1992 | Markel | 175/4.6 |
| 5,107,929 | 4/1992 | Lopez de Cardenas | 166/297 |
| 5,421,418 | 6/1995 | Nelson et al. | 175/2 |

*Primary Examiner*—Frank Tsay

[57] ABSTRACT

A through-tubing perforating gun and method is provided. The assembly comprises an elongated carrier strip, a plurality of perforating charges, and means for connecting the plurality of charges to the carrier strip. Each of the charges has a focal axis along which a shaped charge explosion occurs in a firing direction when the charge is actuated for use in perforating the casing wall, a cross-section that fits within a circle defined by the smallest inner diameter of the well tubing through which the assembly is intended to pass, and a detonating cord receiving means. The means for connecting the plurality of charges to the carrier strip is such that: the cross-sections of the plurality of charges substantially overlap along the line extending parallel to the length of the carrier strip, whereby the overall cross-section of the assembly fits within a circle defined by the smallest inner diameter of the well tubing through which the assembly is intended to pass; and at least one of the plurality of charges has its focal axis angularly displaced at least about 30 degrees relative to the focal axis of the next adjacent perforating charge; and the focal axis of any one of the plurality of perforating charges is angularly displaced from the focal axis of the next adjacent perforating charge no more than about 80 degrees. The means for connecting can comprise a mounting clip. More preferably, the clip is mountable to the strip in two orientations. Further, the clip is adapted such that a perforating charge is mountable to the clip in two orientations. Thereby, the clip provides a plurality of charge mounting orientations.

16 Claims, 8 Drawing Sheets

PERFORATING CHARGE CARRIER ASSEMBLY AND METHOD

This is a continuation-in-part of U.S. application Ser. No. 08/311,284 filed Sep. 22, 1994 entitled Perforating Charge Carrier Assembly, which is now U.S. Pat. No. 5,590,723, which is incorporated by reference herein in its entirety.

TECHNICAL FIELD

This invention relates to improved perforating assemblies and methods for insertion through well tubing for use in perforating the well casing.

BACKGROUND OF THE INVENTION

Conventional perforating guns used in perforating well casings typically include charge carriers designed to support a number of separate perforating charges, such as shape charges, within the desired longitudinal spacing and in some case a desired radial orientation. In perforating guns which must pass through a reduced diameter tubing or other downhole restrictions to reach the location in the casing where perforation is to be performed, cross-sectional profile is important. For example in the perforation of a five-inch casing, it may be necessary for the perforating gun to pass through a relatively small bore, such as two and one-half inch or one and eleven-sixteenth inch tubing or other passageway. These through-tubing type perforating gun assemblies can be characterized as low or small profile assemblies because of the restricted passageways through which they must pass to reach the perforation location. These low profile perforating guns do not have the luxury of design spacing which is present in perforating gun assemblies whose maximum outside dimensions approximate that of the casing which is to be perforated. These small profile or through-tubing perforating assemblies have particular problems which are not present in their larger profiled cousins.

As is well-known in the industry, perforating gun assemblies utilize perforating shape charges which are explosive charges that are designed to shape and direct the explosion with great precision along the focal axis. Typically, a perforating shape charge will shape and direct a liner material to create a uniform circular jet that is highly focused and directed along a focal axis. The jet penetrates the casing that lines the well bore and the surrounding geological formation to enhance production.

In general it is desirable to maximize the number of perforations and their radial orientation in a single-shot procedure. Therefore, it would be ideal to pack the charges as densely as possible. High-density charges are axially spaced so that they are almost touching, i.e., their centers are axially spaced about the maximum axially extending thickness of the charge. It has also been found that phasing the charges, i.e., varying their radial direction, increases production. However, in low profile perforators, this type of geometry creates problems.

One problem in packing the perforating charges as close to one another as possible in the small profile through-tubing perforator assemblies has been the likelihood of interference between the charges. While the bulk of the energy from the explosion of a shape charge is directed to form the perforating jet, shock waves emanate laterally from the firing of the shape charge. If the perforating charges are not properly spaced the lateral shock waves from one charge can interfere with the proper operation of the next charge, for example, by distorting the focus and direction of the firing of the adjacent shape charge. In large profile perforators and in low profile perforators with charges that are substantially spaced apart, interference is minimized because the charges are a sufficient distance apart to avoid interference. In large profile perforators, the charges may be phased without unduly extending the detonating cord length so that sequential firing occurs before lateral shock wave interference results. In small profile perforators without phasing, detonator cords are sufficiently short to cause sequential firing before lateral shock wave interference occurs. However, in high-density small profile perforating gun assemblies, multiphasing results in undesirable extension of detonating cord lengths and undesirable interference. This is due to the fact that in small profile carriers phasing results in angular displacement of the point at which the detonating cord attaches to the charges and, therefore, a lengthening of the cord and time delay between adjacent detonations.

Thus, there is a need for a small or low profile through-tubing perforating charge carrier assembly that can provide high perforator charge density while minimizing adjacent charge interference.

SUMMARY OF THE INVENTION

According to the invention, improved assemblies and methods are provided for insertion downhole through well tubing for use in perforating the well casing. More particularly, improved assemblies and methods are provided that facilitates the arranging of the perforating charges on a carrier strip at any of a plurality of radial orientations. Furthermore, improved assemblies and methods are provided that allow increased linear density of the perforating charges on a carrier strip while permitting several radial orientations to achieve desired radial perforation of a well casing.

According to one aspect of the invention, the perforating assembly comprises an assembly of an elongated carrier strip assembly wherein a first elongated carrier strip and a second elongated carrier strip may be coupled with one another by a coupling plate. The coupling plate has a means for connecting at least one perforating charge thereto. Thus, the coupling plate minimizes any gap in linear spacing of perforating charges or can be used without interrupting a uniform spacing of perforating charges throughout the assembly. In one preferred implementation, the coupling plate includes a central portion which will abut proximal adjacent ends of the first and second carrier strips. This central portion has coupled to it longitudinally opposed end pieces which are laterally offset to one side of the central portion, such that they will overlie the interior surfaces of the carrier strips. These end portions may be appropriated coupled, such as through bolts, to corresponding apertures in the first and second elongated carrier strips. The central portion of the coupling plate will preferably include one or more apertures, or other appropriate mechanisms, for securing a perforating charge to the remainder of the assembly. Accordingly, through use of end portions which do not interfere with adjacent spaced shape charges, the first and second elongated carrier strips may be coupled together, with a perforating charge in the coupling plate such that uniform spacing of shape charges is achieved throughout the assembly.

According to another aspect of the invention, a novel configuration of a mounting clip and a perforating charge cooperate with an elongated carrier strip to facilitate an optimal distribution of perforating charge shot orientation with minimal componetry. In one particularly preferred embodiment, the assembly includes a mounting clip which defines a support face which will essentially lie perpendicular to the firing direction of a shape charge, and which also defines a mounting plane which is defined by tabs or other members which couple to an elongated carrier strip. If the plane of the support face and the plane of the mounting face are extended, they would preferably interest one another and form an angle in the range of about 30 degrees to about 80 degrees. In a particularly preferred embodiment, the angle of intersection would in the range of about 45 degrees and about 57 degrees.

According to a further aspect of the invention, the clip is mountable in two orientations, wherein the support face extends to opposite sides of the plane symmetrical to the carrier strip. Further, the perforating charges are mountable to or through the mounting clip in either of two orientations. The resulting flexibility of mounting can provide a plurality of distinct orientations of the firing direction of each perforating charge relative to the carrier strip.

According to yet another aspect of the invention, an improved perforating charge carrier assembly of the type for insertion downhole through well tubing for use in perforating the well casing is provided. The assembly comprises an elongated carrier strip, a plurality of perforating charges, and means for connecting the plurality of perforating charges to the elongated carrier strip. Each of the perforating charges has a focal axis along which a shaped charge explosion occurs in a firing direction when the perforating charge is actuated for use in perforating the casing wall and a cross-section that fits within a circle defined by the smallest inner diameter of the well tubing through which the perforating charge assembly is intended to pass, and a detonating cord receiving means. The means for connecting the plurality of perforating charges to the elongated carrier strip is such that: the cross-sections of the plurality of perforating charges substantially overlap along the line extending parallel to the length of the elongated carrier strip, whereby the overall cross-section of the perforating charge assembly fits within a circle defined by the smallest inner diameter of the well tubing through which the perforating charge assembly is intended to pass; and at least one of the plurality of perforating charges has its focal axis angularly displaced at least about 30 degrees relative to the focal axis of the next adjacent perforating charge; and the focal axis of any one of the plurality of perforating charges is angularly displaced from the focal axis of the next adjacent perforating charge no more than about 80 degrees.

These and other aspects, features, and advantages of the present invention will be apparent to those skilled in the art upon reading the following detailed description of preferred embodiments according to the invention.

BRIEF DESCRIPTION OF THE DRAWINGS

The accompanying drawings are incorporated into and form a part of the specification to provide illustrative examples of the present invention. These drawings together with the description serve to explain the principles of the invention. The drawings are only for purposes of illustrating preferred and alternate embodiments of how the invention can be made and used and are not to be construed as limiting the invention to only the illustrated and described examples. Various advantages and features of the present invention will be apparent from a consideration of the accompanying drawings in which.

DETAILED DESCRIPTION OF THE PREFERRED EMBODIMENTS

Figure 1:
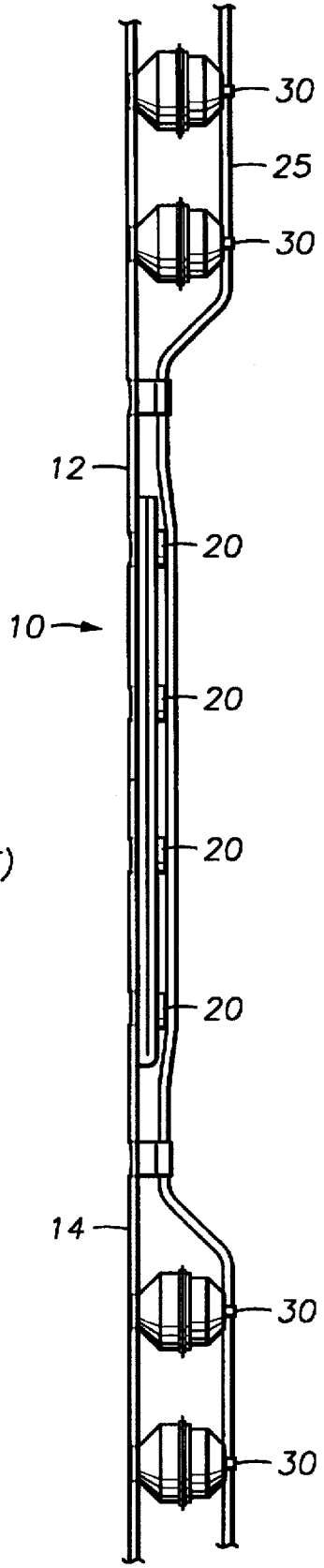
FIG. 1 (PRIOR ART)
FIG. 1 depicts an exemplary prior art carrier strip assembly.

The present invention will be described by referring to drawings of examples of how the invention can be made and used. Like reference characters are used throughout the several figures of the drawing to indicate like or corresponding parts.

Referring now to the drawings in more detail, and particularly to FIG. 1, therein is depicted an exemplary prior art configuration for a carrier strip assembly 10 for supporting perforating charges, such as shaped charges, within a perforating gun. Carrier strip assembly 10 comprises a first elongated strip-carrier member 12 and a second elongated strip-carrier member 14, which are placed in longitudinally aligned, abutting relationship at 16. The longitudinally extending tie plate 18 extends across the abutment and is coupled by a plurality of threaded fasteners, such as bolts 20 to first and second elongated carrier strip members 12 and 14. Tie plate 18, therefore, serves to anchor the two strip-carrier members in longitudinally aligned position. A plurality of shaped charges 30 are coupled to the carrier strip assembly 10, and are interconnected with detonating cord 25 in a conventional manner. However, the particular shaped charges 30 depicted are not believed to represent prior art to the present invention, and in this FIG. 1 are merely representative of any shaped charges that may be employed on such prior art carrier strip assemblies. As is readily apparent from FIG. 1, this type of prior art carrier strip configuration takes up substantial room, and precludes the placement of perforating charges at uniform and uninterrupted spacings throughout the length of the entire strip-carrier assembly 10.

Referring now to FIGS. 2–5 in more detail, therein is depicted an exemplary carrier strip assembly 24, in accordance with one aspect of the present invention. Carrier strip assembly 24 includes first and second strip members 26 and 28, respectively. Strip members 26 and 28 are each elongated members having provisions for the retaining of shaped charges 30 thereto. Coupling the strip member 26 and 28 together, is a coupling plate 32 in accordance with the present invention.

Figure 12:
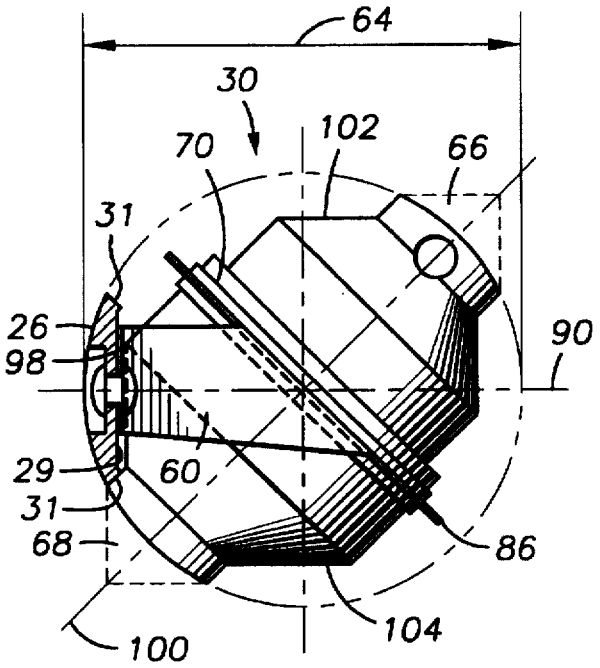
FIG. 12 depicts the apparatus of FIG. 10, through lines 12—12 therein.

Referring briefly ahead to FIG. 12, in this particularly preferred embodiment, each strip member 26, 28 includes a cross-section having a generally curvilinear exterior surface 27 and an opposing generally flat surface 29. A pair of tabs 31 preferably extend from the cross-section beyond flat surface 29. Such a configuration allows each strip member 26, 28 to rest securely against the interior bore of a downhole tubular member (depicted in phantom in FIG. 12).

Figure 3:
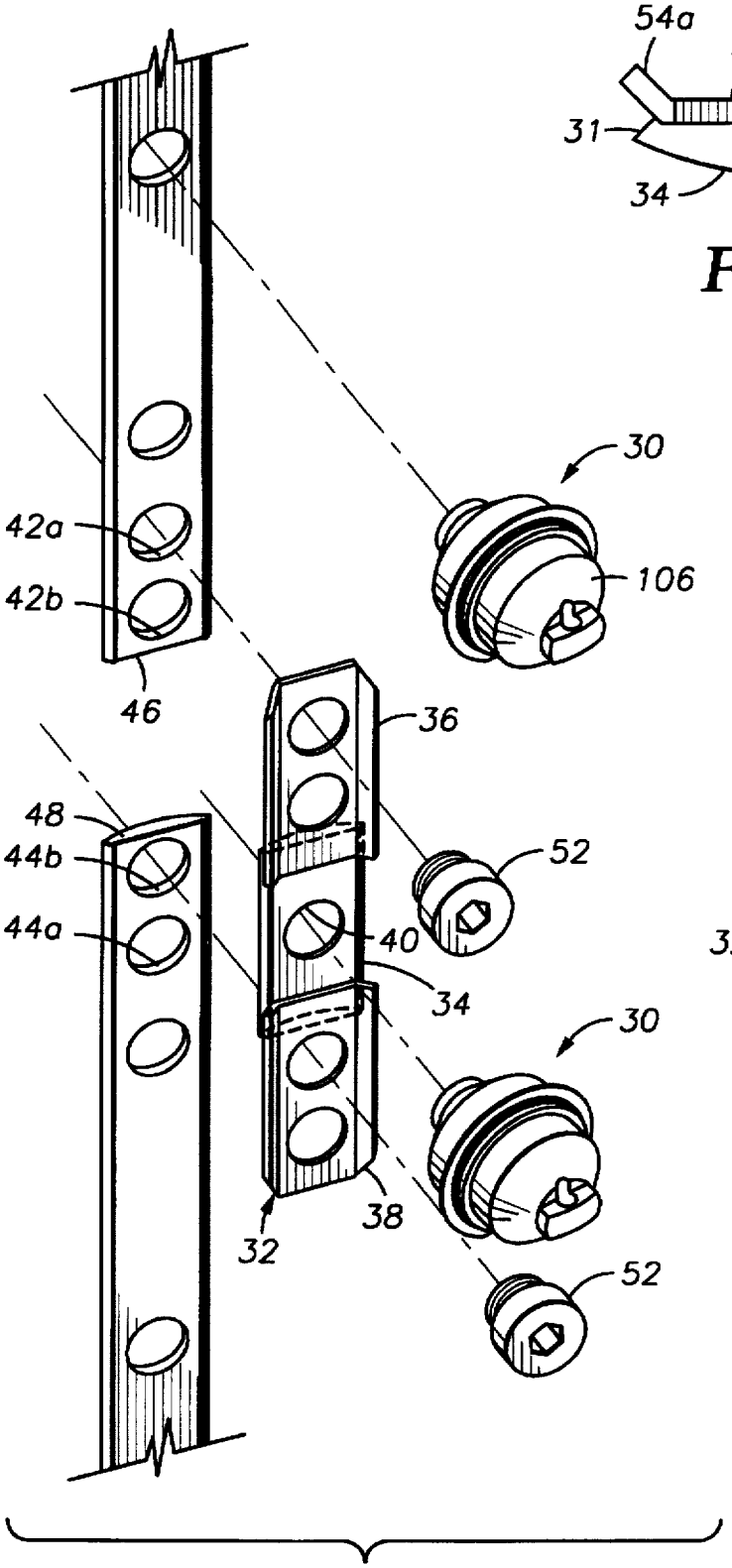
FIG. 3 depicts the carrier strip assembly of FIG. 2 in an exploded view.
Figure 4:
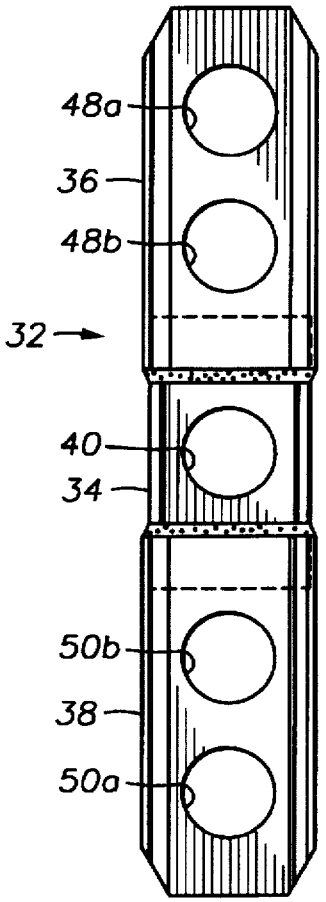
FIG. 4 depicts the coupling plate of FIG. 2 from a top view.
Figure 6:
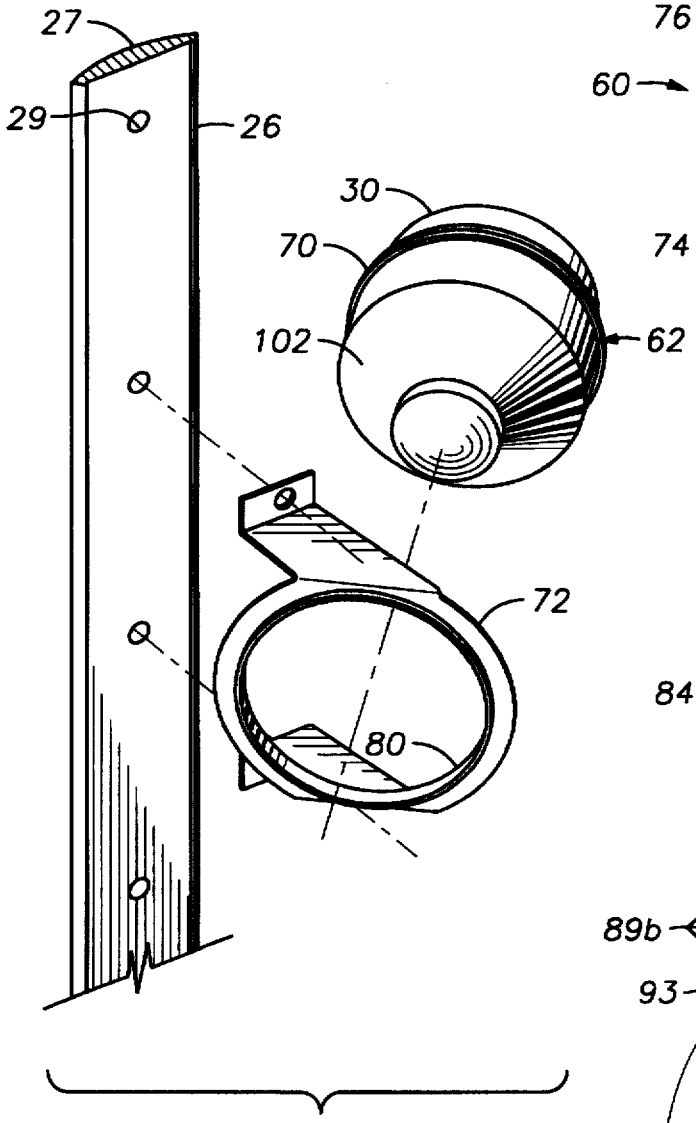
FIG. 6 depicts a clip assembly suitable for use with a carrier strip in accordance with the present invention.
Figure 8:
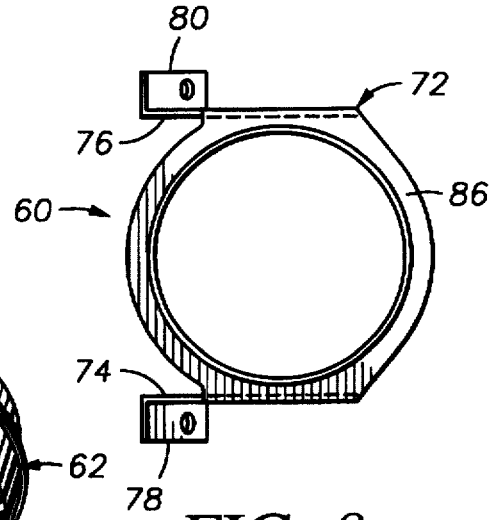
FIG. 8 depicts the clip of FIG. 6 from a frontal view.
Figure 9:
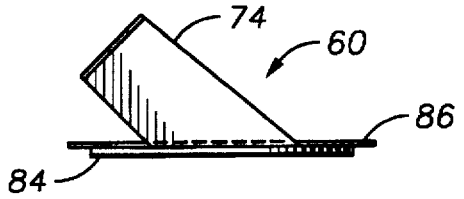
FIG. 9 depicts the clip of FIGS. 6 and 8 from a side view.

As can best be seen in FIGS. 3 and 4, coupling plate 32 includes a central portion 34. Preferably, central portion 34 of coupling plate 30 will be a segment whose cross-section is selected to match that of the strip members to which it will abut. Coupled proximate each end of central portion 34, and generally longitudinally aligned therewith, are first and second end portions 36 and 38, respectively. First and second end portions 36 and 38 are preferably of a comparable cross-section. This cross-section may be either the same as that of central portion 34, or may be different. First and second end portions 36 and 38 of coupling plate 32 will preferably be constructed of a configuration as depicted.

Figure 5:
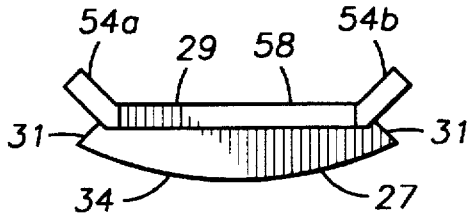
FIG. 5 depicts the coupling plate of FIG. 4 from an end view.

Referring to FIG. 5, coupling plate 32 preferably has flanges 54*a*, 54*b* extending toward one side of a generally flat central portion 58 so as to impart optimal rigidity to coupling plate 32 and to the assembly established through use thereof. In a particularly preferred embodiment as depicted herein, and as shown in FIG. 5, central portion 34 will have a cross-section which essentially matches the cross-section of strip members 26 and 28, while first and second end portions 36 and 38 will have a contrasting cross-section which is adapted to cooperatively engage the inner surface of strip members 26 and 28. First and second end portions 36 and 38 may be coupled to central portion 34 by any appropriate means, such as weldments.

Referring back to FIGS. 3 and 4, in contrast to prior art designs, central portion 34 of coupling plate 32 will include an appropriate mechanism, such as threaded hole 40 (as depicted) for accepting and retaining a correspondingly threaded portion of a shaped charge 30.

First and second strip members will each be provided with a pair of coupling apertures 42*a*, 42*b* and 44*a*, 44*b*, respectively, proximate their respective ends 46 and 48, respectively. These coupling apertures are preferably threaded. Complimentary apertures 48*a*, 48*b* and 50*a*, 50*b* in first and second end-portions 36 and 38, respectively, of coupling plate 32 will align with the aforementioned coupling apertures in strip members 26 and 28 when ends 46 and 48 of strip members 26 and 28 abut the upper and lower ends, respectively, of central portion 34 of coupling plate 32. A plurality of threaded connectors 52 will then threadably engage the coupling apertures of 42*a*, 42*b*, 44*a*, 44*b* in strip members 26 and 28 to secure coupling plate 32 thereto, and to establish a single, longitudinal strip assembly.

Figure 2:
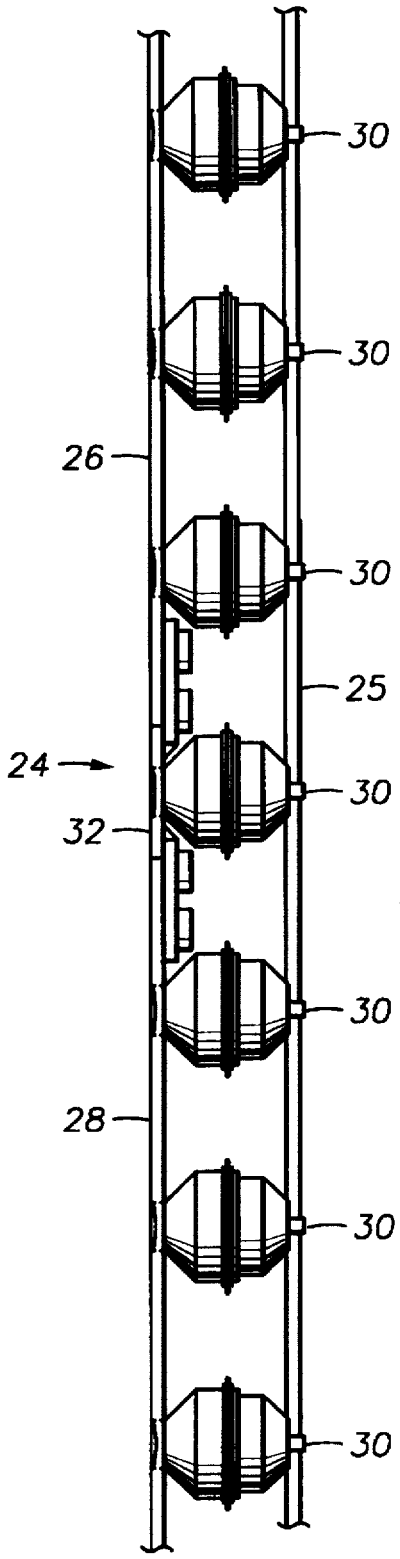
FIG. 2 depicts an exemplary carrier strip assembly including a coupling plate, in accordance with one aspect of the present invention.

As is depicted in FIG. 2, a plurality of shaped charges 30 may be distributed along this assembly including the carrier strips 26, 28 and across the coupling plate 32. The coupling plate 32 according to the present invention thereby facilitates the assembling of a perforating gun which will perforate along the length of the carrier strips 26, 28 and coupling plate 32, avoiding undesirable gaps in the perforating charges. While the carrier strip assembly 24 according to the present invention preferably has the shaped charges 30 distributed along its length at equal and uniform spacing, it is to be understood, however, that a pattern of equal and uniform spacing is desirable, but not required.

Referring now to FIGS. 6–15, therein is depicted a novel charge mounting assembly 60 in accordance with another aspect of the present invention. First referring to FIG. 6, the novel charge mounting assembly 60 may be utilized in accordance with a carrier strip assembly as depicted in FIGS. 1–5, or may be utilized with other types of carrier strips, as may be known to the art. Mounting assembly 60 is designed to function optimally with shaped charges 30 having a housing 62 of a particular configuration. The housing 62 includes an end cap 73 with a detonating cord receiving bore 73*a*.

Referring briefly ahead to FIG. 12, shaped charge housing 62 is of a cross-section configuration which is adapted to fit within a predetermined diameter 64, such as the inner diameter of a relatively small wellbore. Shaped charge housing 62 also includes housing ends which each include 90 degree included angles 66 and 68. Additionally, shaped charge housing 62 includes a central flange 70 which serves as an abutment for a mounting clip 72. The placement of central flange is determined in conjunction with the forming of mounting clip 72.

Figure 7:
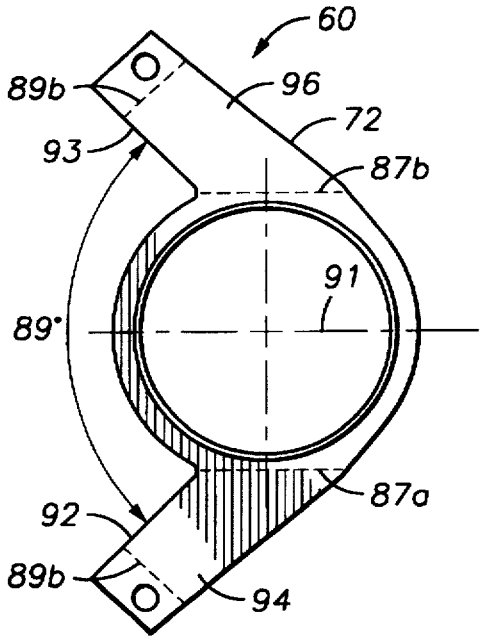
FIG. 7 depicts a stamping by which the clip member of FIG. 6 may be constructed.
Figure 10:
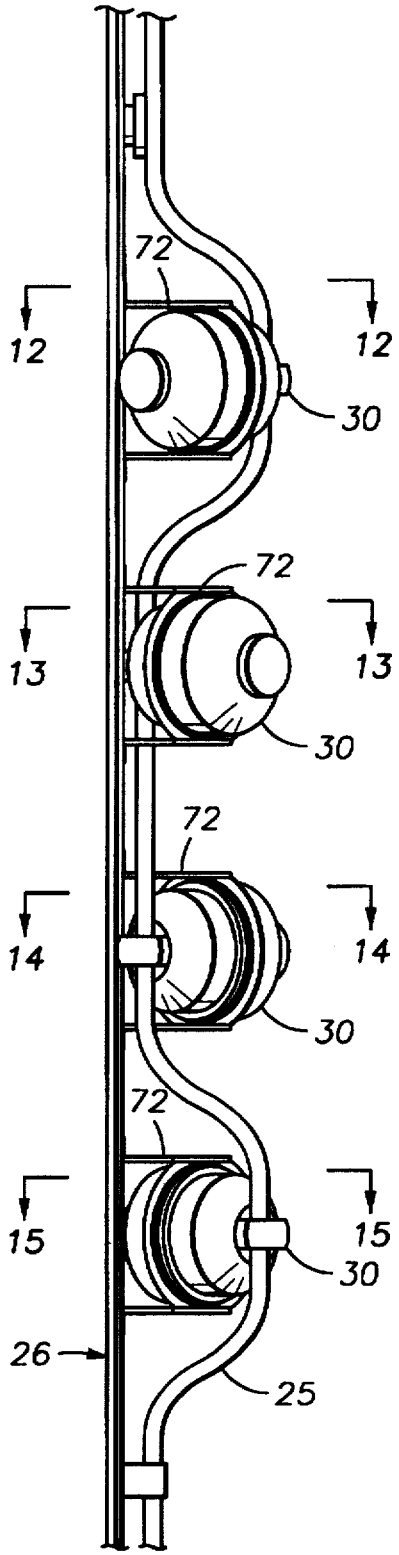
FIG. 10 depicts an exemplary carrier strip assembly including perforating charges demonstrating the capabilities achievable with the apparatus depicted in FIG. 6.
Figure 11:
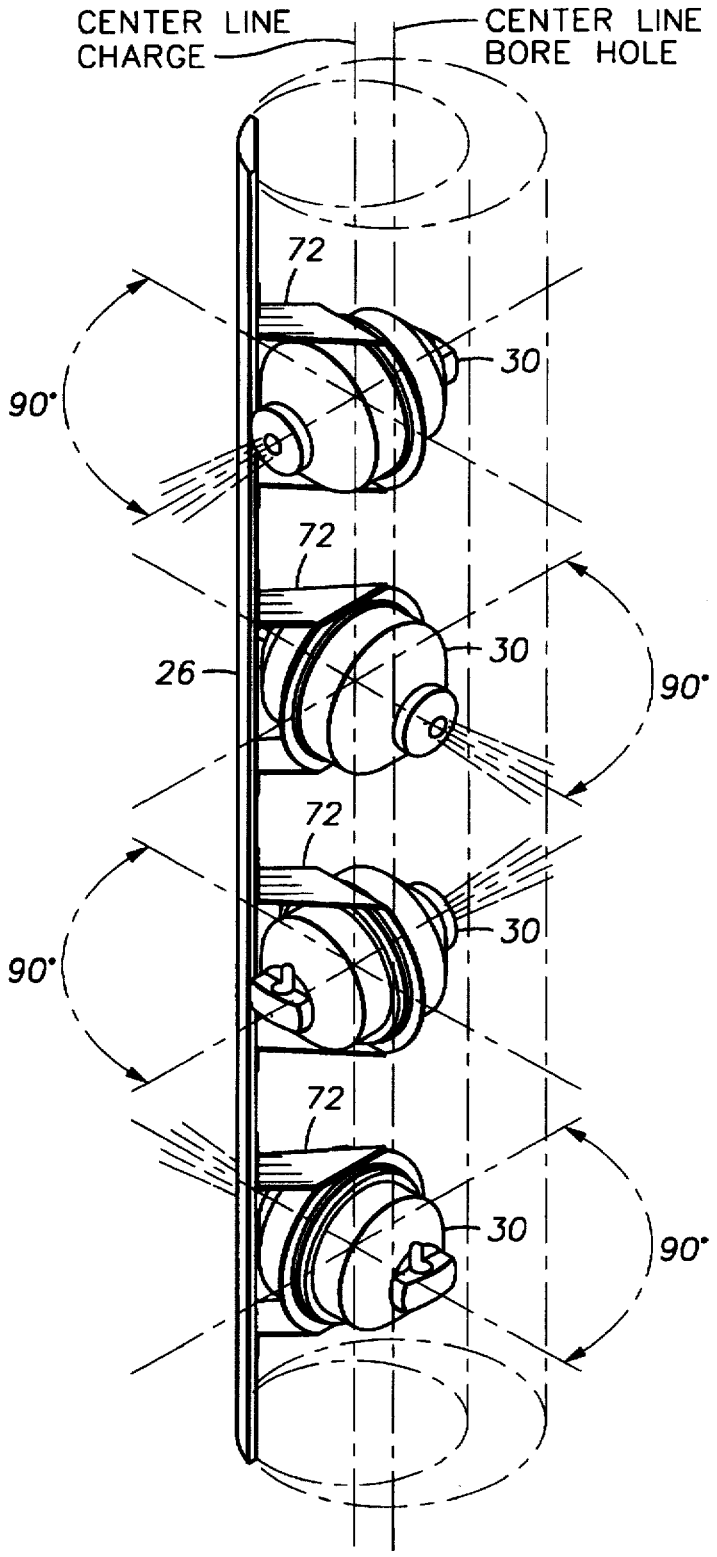
FIG. 11 more clearly depicts the offsets of direction achieved with the apparatus of FIG. 10.

Mounting clip 72 may be stamped or otherwise formed from a flat sheet of material, as depicted in FIG. 7. Such material may be, for example, 28 gauge steel. As will be apparent to those skilled in the art, the precise dimensions of a mounting clip 72 may be selected in response to the size restrictions imposed by the particular carrier strip, housing, and shaped charges utilized. As a flat member, the mounting clip form (FIG. 7) includes flanges 94, 96 extending from a central support face 86. Support face 86 includes a charge-receiving aperture 82. The included angle between said flanges 94, 96, along with the placement of bend lines 87*a*, 87*b* and 89*a*, 89*b* will establish an angular orientation of support face 86 relative to mounting tabs 78 and 80 when mounting clip 72 is formed. In one preferred embodiment, a 90 degree included angle 89 will be formed between inner surfaces 92, 93 of mounting clip form (see FIG. 7). When bend lines 87*a*, 87*b* are oriented parallel to a line 91 bisecting this angle, and when flanges 94, 96 are bent at a 90 degree angle, support face will extend at an angle of 45 degrees relative to a plane extending upwardly across the inner surfaces 92, 93 of flanges 94, 96 forming legs 74, 76.

Once the extending flanges are bent twice at bend lines 87*a*, 87*b* and 89*a*, 89*b* to form downward extending legs 74 and 76 and mounting tabs 78 and 80, mounting clip 72 if formed. In a particularly preferred embodiment, central aperture 82 in mounting clip 72 is surrounded by a slight downwardly extending lip 84, extending from the otherwise relatively planar surface 86 of clip proximate central aperture 82. The placement of central flange 70 on charge housing 62 is preferably determined, but not necessarily, such that shaped charge housing may be inserted from either direction, and will extend essentially symmetrically relative to mounting clip 72.

As can best be seen in reference to FIGS. 12–15, mounting clip 72 may be secured to strip member 26 with the mounting tabs 78 and 80 generally longitudinally arranged along strip member 26 but with the support face 86 extending toward opposite sides of a hypothetical plane 98 symmetrically placed relative to carrier strip 26. In this embodiment, mounting clip 72 will preferably be coupled to the carrier strip through insertable fasteners, such as rivets, engaging apertures 75 in strip 26. Recesses may be provided on the curvilinear surface 27 of strip 26 to accommodate the rivets. In one particularly preferred embodiment, support face 86 of mounting clip 72 will be disposed at an angle which is 45 degrees offset from plane 90, resulting in the axis 100 through said mounter aperture 82 facing 45 degrees offset from plane 90. As is readily apparent to those skilled in the art, however, additional geometrical configurations may also be selected.

As is best depicted in FIG. 12, either front mounting surface 102 or rear mounting surface 104 of shaped charge 30 may lie proximate top surface 29 of strip member 26. Further, inwardly extending tabs 31 will engage either surface 102 or 104 of shaped charge 30 depending on the orientation in which shaped charge 30 is disposed through aperture 82 in mounting clip 72. Thus, as can be seen from a comparison of FIGS. 12 and 14, the depicted assemblies are essentially identical with the exception of the alternate orientation of shaped charge 30 through aperture 82 in mounting clip 72.

Figure 13:
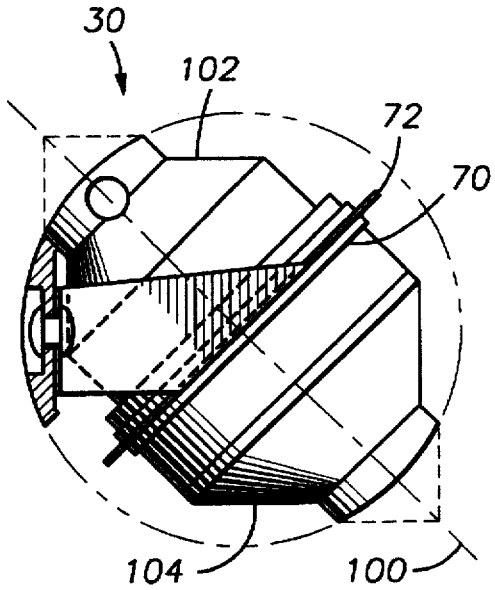
FIG. 13 depicts the apparatus of FIG. 10, through lines 13—13 therein.
Figure 14:
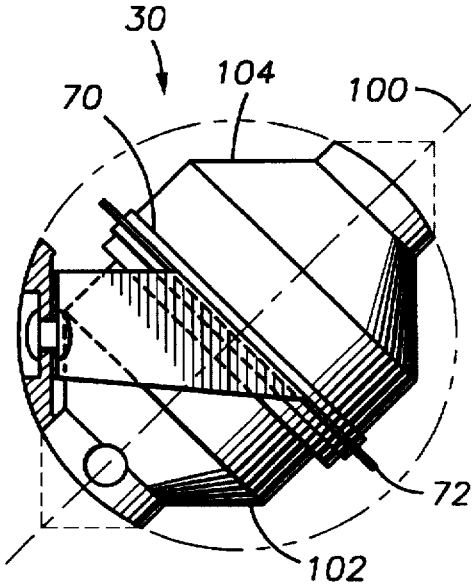
FIG. 14 depicts the apparatus of FIG. 10, through lines 14—14 therein.
Figure 15:
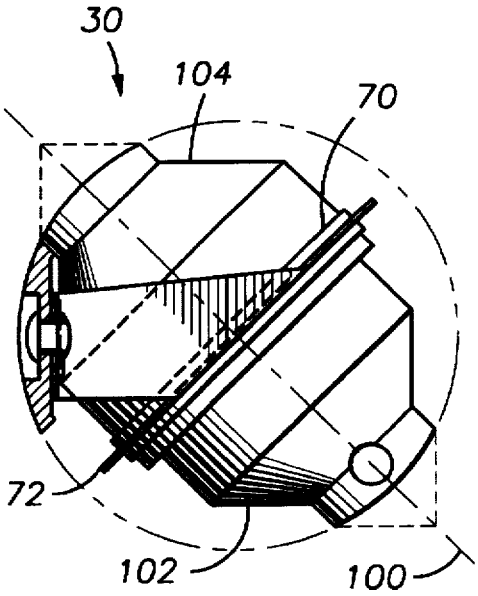
FIG. 15 depicts the apparatus of FIG. 10, through lines 15—15 therein.

In an analogous manner, in FIGS. 13 and 15, mounting clip 72 has been attached to strip member 26' in the reverse orientation (relative to that of FIGS. 12 and 14), and shaped charge 30 is again oriented in alternating directions (between FIGS. 13 and 15). This capability allows one configuration of shaped charge mounting assembly to be assembled in the four configurations depicted in FIGS. 10 and 11, and provide a so-called spiral, with the four longitudinally disposed charges arranged facing in four directions, each offset from the adjacent shots by 90 degrees.

Figure 16:
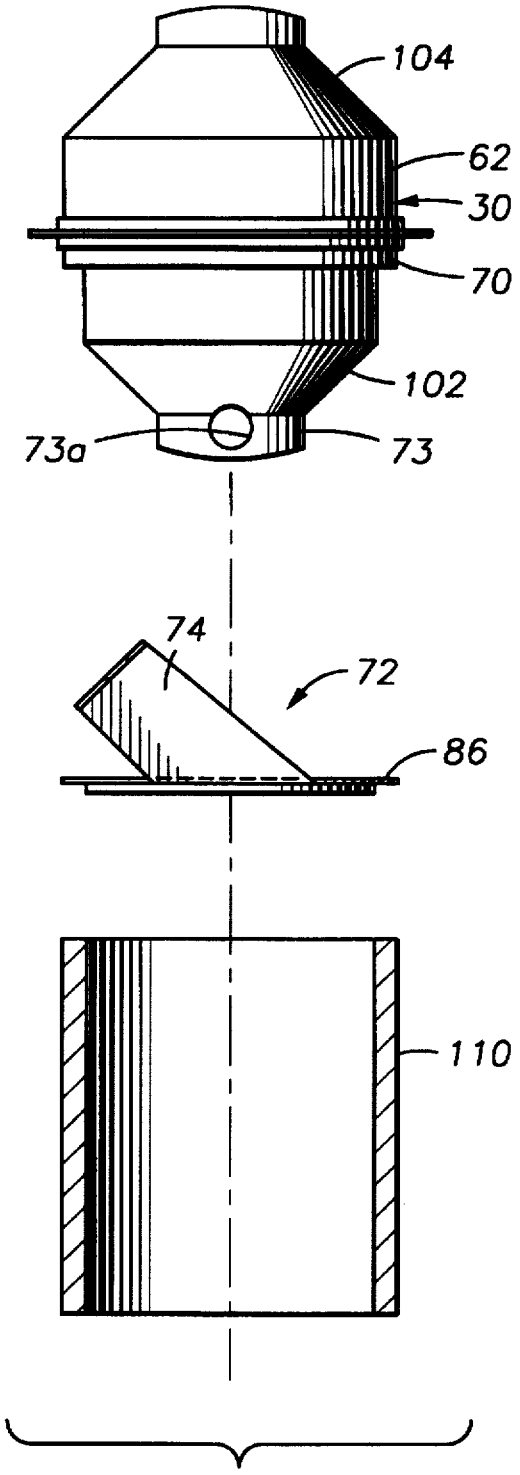
FIG. 16 depicts a cross-sectional view of a shaped charge in the process of being positioned for mounting in a first direction to a mounting clip with the assistance of the use of a charge installation fixture.

Referring now to FIG. 16, the central flange 70 formed on the housing 62 of the shaped charge 30 is used to engage the support face 86 of the mounting clip 72. One of the legs 74 of the mounting clip 72 is clearly shown in FIGS. 16 and 17. Shaped charges 30 can be oriented with the surface 102 or 104 facing either upward or downward relative to the mounting clip 72, and such surface 102 or 104 later assists in engaging the inner surface of a carrier strip as previously described. Shaped charges 30 have an end cap 73 with a detonating cord receiving bore **73*a*** formed therein.

Figure 17:
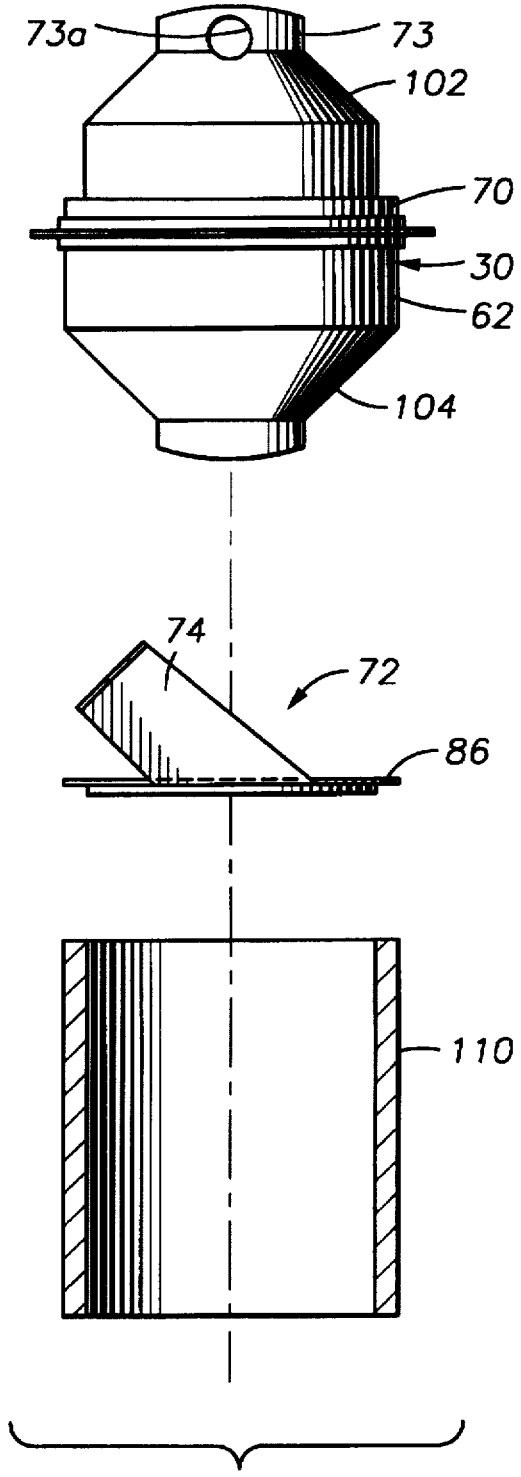
FIG. 17 depicts a cross-sectional view of a shaped charge in the process of being positioned for mounting in a second or reverse direction to an identical mounting clip with the assistance of the use of a charge installation fixture.

As shown in FIG. 16, a shaped charge 30 is shown in the process of being positioned for mounting in a first direction to a mounting clip 72 using a charge installation fixture 110. Such a charge installation fixture is preferably a simple tubular body dimensioned to support the central support face 86 as a shaped charge 30 is being positioned within the charge receiving aperture 82 formed in the support face 86 of the mounting clip 72. The advantage of using such a charge installation fixture is it assists in mounting the charge to the mounting clip without damaging the shaped charge 30. An Arbor press is the best method to press the charges into the clips, however, a short block of wood will also work. Referring now to FIG. 17, a shaped charge 30 is shown in the process of being positioned for mounting in a second or reverse direction to an identical mounting clip 72 using the charge installation fixture 110. This ability to orient the charge 30 either of two ways on the mounting clip 72 provides two degrees of freedom for an identical mounting clip structure. The ability to later orient the legs 74, 76 of the mounting clip 72 in either of two orientations on a carrier strip provides another two degrees of freedom in the ultimate orientation of a charge on a carrier strip. Thus, a single mounting clip 72 can be used to orient a charge 30 on a carrier strip in any of four angular orientations relative to the carrier strip.

According to yet another aspect of the invention, an improved perforating charge carrier assembly of the type for insertion downhole through well tubing for use in perforating the well casing is provided. The assembly comprises an elongated carrier strip, a plurality of perforating charges, and means for connecting the plurality of perforating charges to the elongated carrier strip. Each of the perforating charges has a focal axis along which a shaped charge explosion occurs in a firing direction when the perforating charge is actuated for use in perforating the casing wall and a cross-section that fits within a circle defined by the smallest inner diameter of the well tubing through which the perforating charge assembly is intended to pass, and a detonating cord receiving means. The means for connecting the plurality of perforating charges to the elongated carrier strip is such that: the cross-sections of the plurality of perforating charges substantially overlap along a line extending parallel to the length of the elongated carrier strip, whereby the overall cross-section of the perforating charge assembly fits within a circle defined by the smallest inner diameter of the well tubing through which the perforating charge assembly is intended to pass; and at least one of the plurality of perforating charges has its focal axis angularly displaced at least about 30 degrees relative to the focal axis of the next adjacent perforating charge; and the focal axis of any one of the plurality of perforating charges is angularly displaced from the focal axis of the next adjacent perforating charge no more than about 80 degrees.

It has been discovered that, for a given shaped charge configuration and all else being substantially equal, the perforating charge carrier assembly according to the invention permits the perforating charges to be positioned closer together on a carrier strip member. Without being limited by the following theoretical explanation, it is believed that the arrangement of the shaped charges gives the ability to support one or more radially displaced perforating charges up to a radial displacement of up to about 80 degrees relative to one another, without unduly lengthening the detonating cord distance between the charges. Thus, using a fast detonating cord, such as one commercially available from Accurate Arms having a lead jacket and 87 grains per foot, the time between the detonation of adjacent charges can be kept short enough to minimize or eliminate interference from one detonation to the next in the series of charges. The ability to radially orient the perforating charges in a series is provided, such that the cross-sections of the charges are substantially overlapping to present a small profile for passing through a relatively small wellbore. Thus, the linear density of the perforating charges can be increased, while maintaining desirable degrees of radial displacement in the orientation of adjacent charges.

FIGS. **18*a* and 18*b* depict a perforating charge carrier assembly 200** according to a presently most preferred embodiment of the invention, wherein the perforating charges are oriented in a tri-phase arrangement.

The structure and function of the perforating charges 211 and mounting clips 219 used in the presently most preferred embodiments of the invention represented by assemblies 200 described hereinafter in more detail are most preferably of the same structure as the previously described perforating charges 30 and mounting clips 72; it is to be understood, however, that the principles of this aspect of the invention can be practiced with perforating charges and mounting means of a different design than illustrated herein.

The following are the preferred specifications for a presently most preferred embodiment of a perforated charge carrier assembly having a nominal gun size of 1 11/16 inch (1.688 inch, 4.29 cm). The maximum gun outer diameter is 1.69 inch (4.29 cm). The minimum allowable restriction is 1.718 inch (4.36 cm). Minimum casing outer diameter 4.50 inch (11.43 cm), but can be shot in smaller casing under certain circumstances. Maximum gun length is unlimited, restricted only by lubricator length and rig height. The explosive can be, for example, RDX or HMX. The explosive mass is 7.6 grams. Maximum operating temperature for RDX explosive is 325 degrees Fahrenheit (190 C.) for one hour or for HMX explosive is 375 degrees F. (205 C.) for one hour. The maximum operating pressure is 14,000 pounds per square inch. No wellbore fluid is required. The shot density can be six shots per foot (20 shots per meter) at 114 degree inclusive angle downside phasing. For the presently most preferred embodiment for a 1 11/16 inch assembly, the angular displacement is about 57 degrees.

The following are the specifications for a presently most preferred embodiment of a perforated charge carrier assembly having a nominal gun size of 2 1/8 inch (2.125 inch, 5.40 cm). The maximum gun outer diameter is 2.13 inch (5.41 cm). The minimum allowable restriction is 2.188 inch (5.56 cm). Minimum casing outer diameter 5.00 inch (12.70 cm), but can be shot in smaller casing under certain circumstances. Maximum gun length is unlimited, restricted only by lubricator length and rig height. The explosive can be, for example, RDX or HMX. The explosive mass is 14.0 grams for RDX or 15.0 grams for HMX. Maximum operating temperature for RDX explosive is 325 degrees Fahrenheit (190 C.) for one hour or for HMX explosive is 375 degrees F. (205 C.) for one hour. The maximum operating pressure is 15,000 pounds per square inch. No wellbore fluid is required. The shot density can be six shots per foot (20 shots per meter) in the hereinafter described tri-phase arrangement. For the presently most preferred embodiment for a 2 1/8 inch assembly, the angular displacement is about 45 degrees.

In the presently most preferred embodiment for making and using a perforated charge carrier assembly according to the present invention, the following assembly tools are required for proper assembly:

1. Hawk Blasters Multimeter SD-109;
2. Charge tightening wrench for 1 11/16 inch system or 2 1/8 inch system;
3. 3/8" Allen wrench;
4. Cap crimper;
5. Wire stripper;
6. Detonator safety tube assembly;
7. 7/32×12 in (0.56×30.48 cm) Positioning rod;
8. Pop rivet gun—pneumatic;
9. Clip installation fixture for 1 11/16 inch system or 2 1/8 inch system; and
10. Arbor press (hand operated).

Figure 18A:
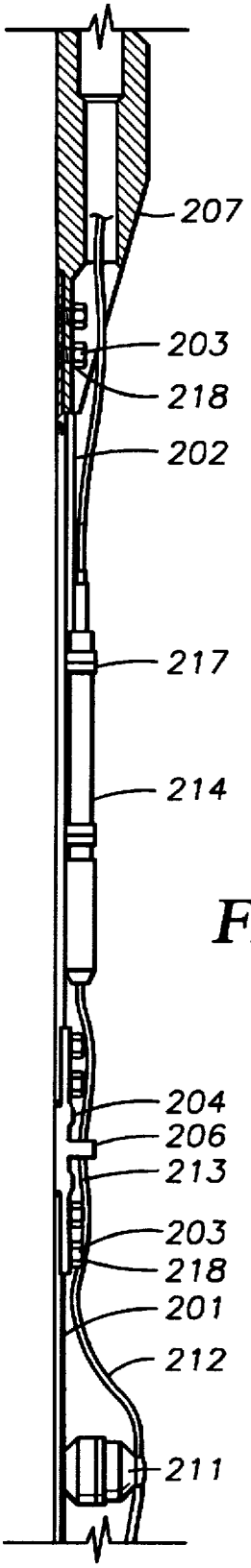
FIGS. 18*a* and 18*b* depict a perforating charge carrier assembly according to a presently most preferred embodiment of the invention, wherein the perforating charges are oriented in a tri-phase arrangement.
Figure 18B:
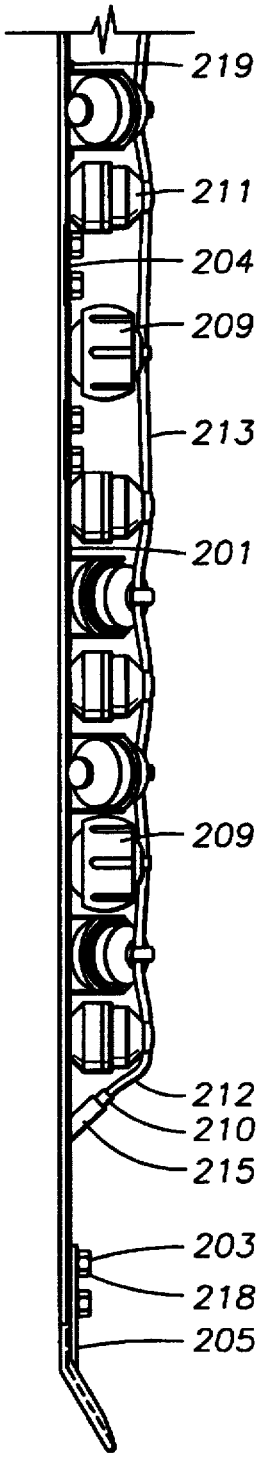

Referring now to any of FIGS. 18*a* and 18*b* of the drawing, the following steps are for the assembly of the carrier strips and firing head 207 of a perforating charge carrier assembly according to a presently most preferred embodiment of the invention:

1. Place carrier strip 201 on a flat surface with curved edges facing upward.
2. Determine what length of carrier strip 201 will be used and if more than one strip will be required. If a coupling plate is required, go to step #3, if not, go to step #4.
3. Position carrier strips end to end and proceed to secure them together with the coupling plate 204 using four bolts 203. (Note: if any of the phased alignments are being loaded, do not make-up the coupling plate 204 and carrier strip 201 at this time.) Firmly tighten bolts 203, but do not over tighten. After tightening bolts, turn the assembly over and screw jam nuts 218 onto each bolt using a 9/16 inch wrench or socket to prevent the bolt from backing out on the way out of the hole after the gun is fired.
4. Attach bottom guide 205 to the end of carrier strip 201. Insert two bolts 203 through the bottom guide 205, attach to carrier strip 201, and tighten. Attach jam nuts 218 to each bolts 203 as in step #3 above.
5. Attach detonator spacer bar 202 to top end of carrier strip 201 using four bolts 203, four jam nuts 218, and a coupling plate 204 . Tighten bolts 203 and nuts 218 securely as in step #3 above.
6. Attach the firing head 207 to the spacer bar 202. The firing head 207 requires three bolts 203 and jam nuts 218 to be secured onto the spacer bar 202. Tighten the bolts 203 securing as in step #3 above.

Referring now to FIGS. 18*a* and 18*b* of the drawing unless otherwise noted, the following steps are for the installation of the charges in a tri-phase arrangement onto the carrier strip(s) of a perforating charge carrier assembly according to a presently most preferred embodiment of the invention:

1. Determine the number of charges required to load the carrier strip 201. One-third (1/3) of these will be installed in the zero degree phase position, the other two-thirds (2/3) will be installed onto a mounting clip 219 prior to being attached to the carrier strip 201.
2. Referring briefly to FIG. 16, place the mounting clip 219 (represented in FIG. 16 by reference numeral 72) upside down on the clip installation fixture 209. Take the charge 211 with the cap (threaded end) up and visually align the detonator cord 213 hole to run parallel with the legs of the clip. Press the charge 211 into the clip. An Arbor press is the best method to press charges into clips. A short block of wood will also work if it is pressed evenly by hand. Install all charges in this group in this manner.
3. Load the charges 211 in the zero phase position of the carrier, by securely screwing each charge 211 into position, using the appropriate wrench from the required assembly tools. NOTE: The first charge 211 on the top strip will be mounting in the second zero phase position and the last charge 211 on the bottom strip will be mounted in the next to last zero phase position. This allows for mounting of the zero phase detonating cord protector 212 to the top and bottom of the assembly.
4. Load a charge 211 into each coupling plate 204 used by securely screwing the charge 211 into position, using the appropriate tightening wrench. Do not use pliers, pipe wrenches, or channel locks to install and tighten the charges, as these can damage the charges pressure integrity.

5. Once the zero phase charges and those in the coupling plates have been attached, the detonating cord holes 220 must be aligned parallel to the strip to facilitate threading of the detonating cord 213. This can be done by rotating the charge body clockwise with a small metal rod inserted into the detonating cord hole or the use of a crescent wrench on the flats, perpendicular to the holes 220 at the top of the charge 211. Install a rollover sleeve 209 on each coupling plate charge 211 and at the lower end of the bottom carrier.
6. To align the detonating cord holes 220, such that the detonating cord 213 passes freely through the entire gun length, begin at either end of the carrier strip 201 and use a round rod 7/32 diameter (0.56)×12 inch long (30.48 cm) rod. Pass the rod through the holes 220 to ensure that charges are well aligned.
7. From the group of charges installed on the clips, position the second charge 211 on the carrier strip 201, aligning the cap with the notch in the carrier strip. Do not rivet the clip in place at this time. Begin feeding the detonating cord 213 through the charges 211.
8. Position the fourth charge 211 (every other charge in this alignment is at zero degrees) on the carrier strip 201 aligning the cap with the notch in the strip (charge will be mirror of charge in position 2). Continue feeding the detonating cord 213 through the charges.
9. Repeat steps 7 and 8 until all the charges have been positioned on the strip and the detonating cord 213 run from top to bottom.
10. Align the holes in the mounting clip 219 and the carrier strip 201, insert rivets and rivet in place. NOTE: Do not use hand operated rivet tools. Failure to use the appropriate rivet gun will result in rivets and mounting clips not being seated properly against the carrier strip 201.
11. Feed the detonating cord 213 through the detonator cord protector 212 at the first and last charge 211 and bolt the protector to the carrier strip 201.
12. Install the detonating cord retainer 206 with the first charge 211 of the carrier.
13. Exercise caution when cutting the detonating cord 213, leaving extra length of cord to attach the detonator 214 and end seal 215.
14. Push detonating cord end seal 215 over bottom end of detonating cord 213 and secure with seizing cord 210.
15. Install detonating cord 213 with end seal 215 to the detonating cord protector 212 and secure by wrapping seizing cord 210 around the protector and detonating cord.

The following steps are for arming the gun according to a presently preferred embodiment of the invention:

1. Ensure that the cable is in SHORT or SAFE position. NOTE: Do not use an ohm-meter in the following steps! Use blasting multimeter only.
2. Check the firing circuit for continuity with a blasting multimeter in the R*1 position. With the blasting multimeter first in the D.C. and then in the A.C. voltage position, ensure that no stray voltage is present.
3. Attach the loaded carrier strip 201 with firing head 207 to CCI or magnetic decentralizer and tighten.
4. Check electric detonator 214 for continuity.
5. Insert detonator 215 into safety tube and attach a detonator lead wire to the lead wire from the firing head 207 assembly.
6. Permanently ground the second wire from detonator 214 to carrier (see FIG. 17).
7. NOTE: This step must be followed before detonating cord 213 is attached. Remove detonator 214 from the safety tube.
8. Mark detonating cord 213 flush with end of the firing head 207, add approximately 1.5 inch (3.81 cm) to the length and cut the cord 213, making sure cut is square with no loose explosive.
9. Attach the detonator 214 to the spacer bar 202 using the appropriate retaining clamps 217. NOTE: If all steps have been followed, detonator 214 and carrier are considered armed at this step and all safety precautions should be maintained.

If the loaded carriers are returned to the surface after being down-hole, the following steps are recommended for the down loading of carrier assemblies according to a presently preferred embodiment of the invention:

1. Remove the electric detonator 214 from the detonator bar 202, and disconnect the detonating cord 213 from the detonator 214.
2. Remove the lead wire connections. Connect the detonator lead wire to the detonator ground device and return to proper storage.
3. Cut the charge retainer clip in the center with tin snips and remove the charges. After all the mounting clips have been cut and charges removed from the carrier, remove the detonating cord 213 from the charges.
4. Unscrew any charges in the zero phase position from the strip using the appropriate installation wrench.
5. Return the charges and detonating cord 213 to proper storage.
6. Grip the exposed rivets with vise grips and drilling from the curved side of the strip drill the rivets out of the strip, using a #29 (0.136) diameter drill bit, being careful not to drill into the strip.

Figure 19:
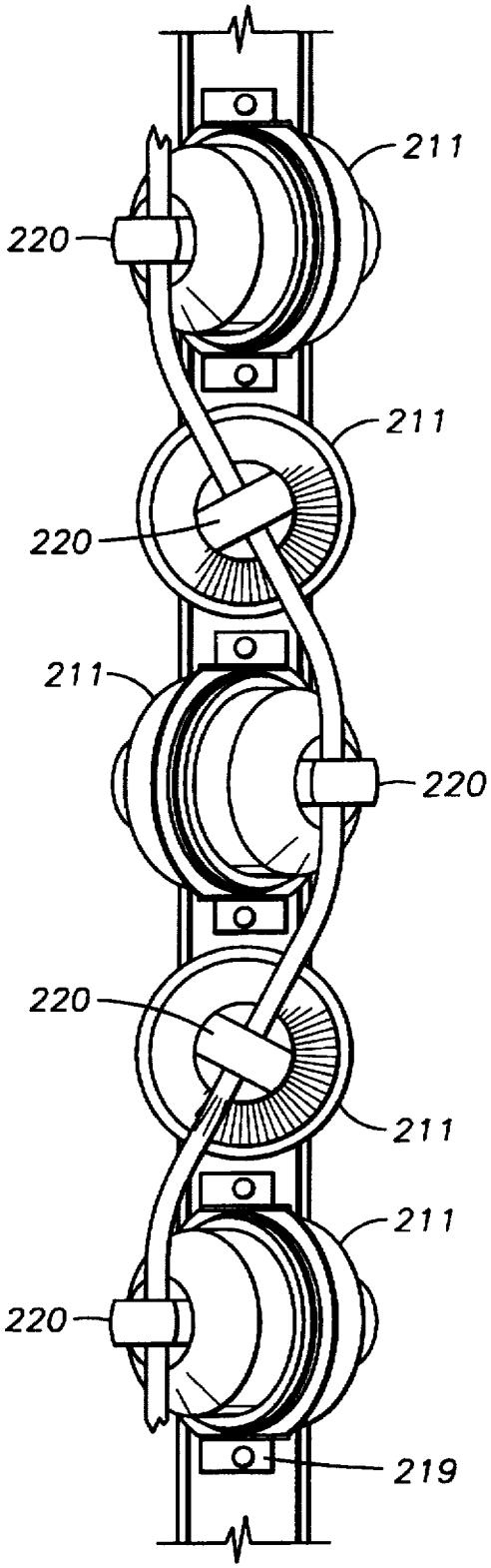
FIG. 19 depicts a top view in more detail of a section of the tri-phase perforating charge carrier assembly shown in FIGS. 18*a* and 18*b*, wherein the mounting of the clips and charges is shown more clearly.

Referring now to FIG. 19 of the drawing, a different view of a segment of the tri-phase perforating charge carrier assembly is shown. FIG. 19 illustrates the arrangement of the perforating charges 211 and the manner in which the structure allows the detonating cord 213 to be maintained relatively short despite the radial displacement of adjacent charges on the strip 201. The detonating cord 213 is threaded through the detonating cord receiving bore formed in the end cap 220 of each charge 211.

Figure 20:
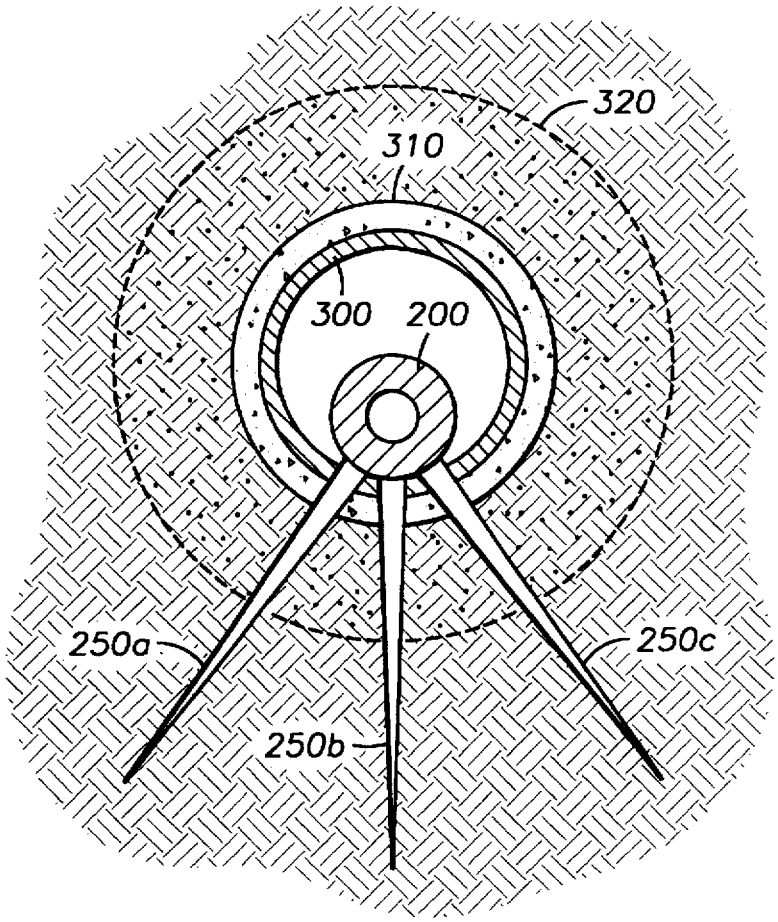
FIG. 20 depicts a graphical representation of a cross-section or profile view of a tri-phase perforating charge carrier assembly in downhole tubing.

FIG. 20 depicts a graphical representation of a cross-section or profile view of a tri-phase perforating charge carrier assembly 200 downhole in a well. The assembly 200*c* is shown positioned on the downward side of well tubing 300. Region 310 represents concrete casing surrounding the well tubing 300. The oil producing formation 320 is represented by phantom line surrounding the well tubing 300 and concrete casing 310. Arrows 250*a*, 250*b*, and 250*c* represent tri-phase perforations created by the plurality of shaped charges 211 of the tri-phase perforating charge carrier assembly 200. As can be seen from FIG. 20, if the included angle between perforations represented by arrows 250*a–e* become excessively large, the charge will fire through increasing amounts of fluid in the well tubing 300, which diminishes the effectiveness of the perforation. Thus, it is desirable to provide a range of orientations in perforating charges to increase well production, but not such a wide included angle of shot perforations that the energy of a perforating charge is wasted in passing through substantial distances of fluid in the well bore.

So long as the radial displacement of adjacent charges is maintained within the limits of the invention, the placement of the charges can be in any desirable arrangement. Presently most preferred embodiments include the previously illustrated 90 degree downside, 90 degree spiral, or tri-phase arrangements, which represent uniform and relative close spacing of perforating charges in a repeating pattern. However, it is to be understood that other patterns, or even non-uniform spacings with non-uniform radial displacements can be employed according to the invention without departing from its scope.

The embodiments shown and described above are only exemplary. Even though numerous characteristics and advantages of the present inventions have been set forth in the foregoing description, together with the details of the structure and function of the invention, the disclosure is illustrative only, and changes may be made in the detail, especially in the matters of shape, size, and arrangement of parts within the principles of the invention to the full extent indicated by the broad and general meaning of the terms used in the attached claims.

The restrictive description and drawings of the specific examples above do not point out what an infringement of this patent would be, but are to provide at least one explanation of how to make and use the inventions. The limit of the inventions and the bounds of the patent protection are measured by and defined in the following claims.

Having described the invention, what is claimed is:

1. A perforating charge carrier assembly of the type for insertion downhole through well tubing for use in perforating the well casing, the assembly comprising:

(a) an elongated carrier strip;

(b) a plurality of perforating charges, each perforating charge having:

(i) a focal axis along which a shaped charge explosion occurs in a firing direction when said perforating charge is actuated for use in perforating the casing wall;

(ii) a cross-section that fits within a circle defined by the smallest inner diameter of the well tubing through which the perforating charge assembly is intended to pass; and (iii) a detonating cord receiver located at the end of said focal axis opposite said firing direction for use in firing said charge; and (c) at least one mount connecting said plurality of perforating charges to said elongated carrier strip such that:

(i) the cross-sections of said plurality of perforating charges substantially overlap along a line extending parallel to the length of said elongated carrier strip, whereby the overall cross-section of the perforating charge assembly fits within a circle defined by the smallest inner diameter of the well tubing through which the perforating charge assembly is intended to pass;

(ii) at least one of said plurality of perforating charges has its focal axis angularly displaced at least about 30 degrees relative to the focal axis of the next adjacent perforating charge;

(iii) the focal axis of any one of said plurality of perforating charges is angularly displaced from the focal axis of the next adjacent perforating charge no more than about 80 degrees; and (d) detonation cord interconnecting said detonating cord receiver.

2. The perforating charge carrier assembly according to claim 1, wherein the focal axis of any one of said plurality of perforating charges is angularly displaced from the focal axis of the next adjacent perforating charge no more than about 57 degrees.

3. The perforating charge carrier assembly according to claim 1, wherein said plurality of perforating charges are arranged in a tri-phase pattern.

4. The perforating charge carrier assembly according to claim 1, wherein the smallest inner diameter of the well tubing through which the perforating charge assembly is intended to pass is 2⅛ inch.

5. The perforating charge carrier assembly according to claim 1, wherein the smallest inner diameter of the well tubing through which the perforating charge assembly is intended to pass is 1 11/16 inch.

6. The perforating charge carrier assembly according to claim 1, wherein said elongated carrier strip further comprises:

a first elongated carrier member configured to support a plurality of perforating charges, said first elongated carrier member having a first cross-section;

a second elongated carrier member configured to support a plurality of perforating charges, said second elongated carrier member having a second cross-section;

a coupling plate coupled between said first and second elongated carrier members, said coupling plate having a first section extending between said first and second elongated carriers, and having second and third sections being laterally offset to one side of said first section and longitudinally disposed on either end of said first section.

7. The perforating charge carrier assembly of claim 6, wherein the cross sections of said first and second elongated carrier members are substantially identical, and wherein said first section of said coupling plate has a cross-section that is substantially the same as that of the cross-sections of said first and second elongated carrier members.

8. The perforating charge carrier assembly of claim 7, wherein said second and third sections are coupled to said first portion by a weldment.

9. The perforating assembly of claim 8, wherein said first section of said coupling plate includes an attachment mechanism for retaining a perforating charge to said first section.

10. The perforating charge carrier assembly of claim 1, wherein said mounts further comprise: at least one mounting clip for at least one of said plurality of perforating charges.

11. The perforating charge carrier assembly of claim 10, wherein said mounting clip further comprises:

leg structure for connecting said mounting clip to said elongated carrier strip and for structurally supporting a support face, said support face extending to one side of said elongated carrier strip when said mounting clip is secured thereto, said support face having a central aperture for receiving a perforating charge.

12. The perforating charge carrier assembly of claim 11, wherein said leg structure configured to be mountable to said strip member in at least two different orientations, whereby said at least one of said plurality of perforating charges can be optionally mounted in either of at least two orientations relative to said elongated carrier strip.

13. The perforating charge carrier assembly of claim 11, wherein said central aperture of said support face is adapted for receiving and supporting said at least one of said plurality of perforating charges in either of at least two orientations, whereby said at least one of said plurality of perforating charges can be optionally mounted in either of at least two orientations relative to said elongated carrier strip.

14. The perforating charge carrier assembly of claim 11, wherein said elongated carrier strip comprises a generally planer inner surface, and wherein said support face extends away from said planar or support surface at an angle between about 30 degrees and about 80 degrees.

15. The perforating assembly of claim 11, wherein said assembly comprises a plurality of mounting clips, and wherein each of said mounting clips are coupleable to said elongated carrier strip in either of two orientations, with said support face extending to opposite sides of said strip member when coupled in said two orientations.

16. The perforating assembly of claim 10, wherein said perforating charge comprises a housing, and wherein said charge housing and said elongated carrier strip are cooperatively configured to engage one another when said perforating charge is engaged between said mounting clip and said strip member and when said mounting clip is secured to said strip member.

* * * * *